United States Patent [19]

Gans

[11] Patent Number: 4,460,897

[45] Date of Patent: Jul. 17, 1984

[54] SCANNING PHASED ARRAY ANTENNA SYSTEM

[75] Inventor: Michael J. Gans, Monmouth Beach, N.J.

[73] Assignee: Bell Telephone Laboratories, Incorporated, Murray Hill, N.J.

[21] Appl. No.: 402,101

[22] Filed: Jul. 26, 1982

Related U.S. Application Data

[63] Continuation-in-part of Ser. No. 250,271, Apr. 2, 1981, abandoned.

[51] Int. Cl.[3] ..... H01Q 3/34; H01Q 3/36; H01Q 3/42

[52] U.S. Cl. ..... 343/754; 343/781 P; 343/786; 343/371; 333/26; 333/238; 455/81

[58] Field of Search ..... 343/786, 854, DIG. 2, 343/754, 781 P; 333/26, 33, 238; 455/80, 81, 327

[56] References Cited

U.S. PATENT DOCUMENTS

| | | | |
|---|---|---|---|
| 3,576,579 | 4/1971 | Appelbaum et al. | 343/778 |
| 3,631,503 | 12/1971 | Tang et al. | 343/754 |
| 3,835,469 | 9/1974 | Chen et al. | 343/754 |
| 4,270,224 | 5/1981 | Blondel et al. | 455/327 |
| 4,330,868 | 5/1982 | Hallford | 455/327 |

OTHER PUBLICATIONS

McMaster et al., Millimeter-Wave Receivers with Subharmonic Pump, IEEE Trans., vol. MTT-24, No. 12, Dec. 1976, pp. 948-952.

Clifton, Schottky-Barrier Diodes for Submillimeter Heterodyne Detection, IEEE, vol. MTT-25, No. 6, Jun. 1977, pp. 457-463.

*Primary Examiner*—Eli Lieberman

*Attorney, Agent, or Firm*—Erwin W. Pfeifle

[57] ABSTRACT

The present invention relates to a phased array antenna system which transmits a local oscillator signal in a scanable spotbeam from a first array of feed elements ($12_l$-$12_m$) via a reflector or lens (16) and a frequency diplexing means (18) to a second array of feed elements ($20_l$-$20_n$) disposed on the image plane of the first array of feed elements. A message signal in a second beam also impinging the frequency diplexing means from a separate direction is also received at the second array of feed elements. The message signal and the local oscillator signal concurrently received at each of the feed elements of the second array are mixed in individual mixers and the output of each mixer can be reradiated for transmission to a remote receiver or combined with the outputs of the other mixers for use by a local receiver. A feed element for use in an antenna for mixing a local oscillator and RF signal to produce an IF or baseband signal, or vice versa, using a stripline arrangement is also disclosed.

9 Claims, 5 Drawing Figures

SCANNING PHASED ARRAY ANTENNA SYSTEM

CROSS-REFERENCE TO RELATED APPLICATION

This application is a continuation-in-part of application Ser. No. 250,271 filed Apr. 2, 1981, abandoned.

BACKGROUND OF THE INVENTION

1. Field of the Invention

The present invention relates to a phased array antenna system which is scanned by means of a directional change of a local oscillator beam and, more particularly, to a phased array antenna system wherein a message signal beam and a local oscillator signal beam, which is selectively directionally changeable, are concurrently received at an array of feed elements. The local oscillator beam signal received at each feed element of the array is added to or subtracted from the individually received message signal in a separate mixer with the output of each mixer being either separately reradiated by a separate feed element of an array of feed elements for transmission or combined with the output signals from the other mixers for reception.

2. Descripiton of the Prior Art

In order to prevent grating lobes from appearing in the field of view of a phased array antenna, the phased array must have N×M elements, where N is approximately the number of beamwidths in the field of view in one plane and M is that in the orthogonal plane. Each of these elements requires a phase shifter which must be individually adjusted to aim the phased array antenna beam anywhere in the field of view. Conventional arrays of this type generally require a large number of phase shifters which may be inappropriate in certain applications as, for example, a satellite scanning beam phased array antenna where factors of complexity, weight, maintenance, aperture size and range of scanability are important factors. Additionally, for many applications such as, for example, certain ground station antennas of a satellite communication system, a factor of cost may also be an important additional factor to certain of those factors specified hereinabove.

U.S. Pat. No. 3,576,579 issued to A. J. Appelbaum et al. on Apr. 27, 1971 attempts to overcome certain of the above-stated factors by providing a planar radial array with a controllable quasi-optical lens which includes a radial line power-dividing means. In accordance with the Appelbaum et al patent, a power feed apparatus is provided which includes a power-dividing means and a power-distributing means. The power-dividing means includes an input port and n output ports and is operative to receive an input signal of a predetermined power level at the input port and to divide the input signal into n output signals of reduced power level at the n output ports. The power-distributing means is operative to receive the n output signals from the n output ports of the power-dividing means and to provide m output signals of varying power levels at m output connections. When the above-described power-dividing and power-distributing apparatus is employed in a power feed apparatus for a phased-array antenna system, the m output signals of varying power levels are used to establish the required power levels for the antenna elements of the array whereby a desired beam taper illumination function is achieved across the aperture defined by the array of antenna elements. The Appelbaum et al arrangement, however, still requires a reasonably large number of feed elements and associated phase shifters.

U.S. Pat. No. 3,835,469 issued to C. C. Chen et al. on Sept. 10, 1974 relates to an optical limited scan antenna system including an aperture lens, a feed lens and a feed array for scanning a pencil beam or multiple simultaneous beams over a limited angular sector with good sidelobe levels and minimum gain degradation. Both amplitude and phase distributions over the aperture lens are controlled for all scan angles. In accordance with the Chen et al arrangement, an aperture lens that is large in diameter compared with that of a feed lens is placed in confocal relationship therewith. Both the aperture and feed lens are entirely passive and are focused by means of fixed phase shifters or line lengths in the elements. A small phased array or other source is used to illuminate a portion of the feed lens with a plane wave segment. This wave passes through the feed lens, converges near the broadside focus at the focal plane, then spreads out again and is intercepted by the aperture lens which refocuses the energy to infinity. By changing the angle of the plane wave emanating from the small feed antenna, the beam is scanned in the far field.

U.S. Pat. No. 3,631,503 issued to R. Tang et al. on Dec. 28, 1971 relates to a high performance distributionally integrated subarray antenna which consists of a feed-through lens with a high-performance feed system. The Tang et al arrangement employs the technique of resolving the radiating array of the feed-through lens into subarrays which overlap each other completely over the entire radiating aperture. Each of the subarrays has a truncated sinx/x amplitude distribution across the entire radiating aperture where x is linear distance therealong, thus producing a radiation pattern closely rectangular in shape. The rectangular subarray pattern is stated as being ideal, since it supposedly maximizes the array gain and minimizes the grating lobe level for a given system bandwidth. Therefore, this overlapping subarray technique supposedly allows the antenna to perform over a wide instantaneous bandwidth with a minimum number of subarrays or time delay phase shifters. Use of this technique also supposedly tends to minimize cost, since the cost of such a system is reflected in the number of subarrays required. This arrangement, however, requires a reasonably large number of feed elements and associated phase shifters in the feed-through lens to provide adequate scanning capabilities and correcting for the spherical aberration of the lens.

The problem remaining in the prior art is to provide a phased array antenna arrangement which provides wide field of view scanning by using cheaper types of phase shifters than normally required.

SUMMARY OF THE INVENTION

The foregoing problems have been solved in accordance with the present invention which relates to a phased array antenna system which is scanned by means of a directional change of a local oscillator beam and, more particularly, to a phased array antenna system wherein a message signal beam and a local oscillator signal beam, which is selectively directionally changeable, are concurrently received at an array of feed elements. The local oscillator beam signal received at each feed element of the array is added to or subtracted from the individually received message signal in a separate mixer with the output of each mixer being either separately reradiated by a separate feed element of an array of feed elements for transmission or combined with the output signals from the other mixers for reception. An advantage of steering the beam of a phased array antenna system with a local oscillator beam which is combined with a fixed or predetermined directional signal beam is that narrowband phase shifters or switches can be used instead of the wideband phase shifters of conventional phased array antennas.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
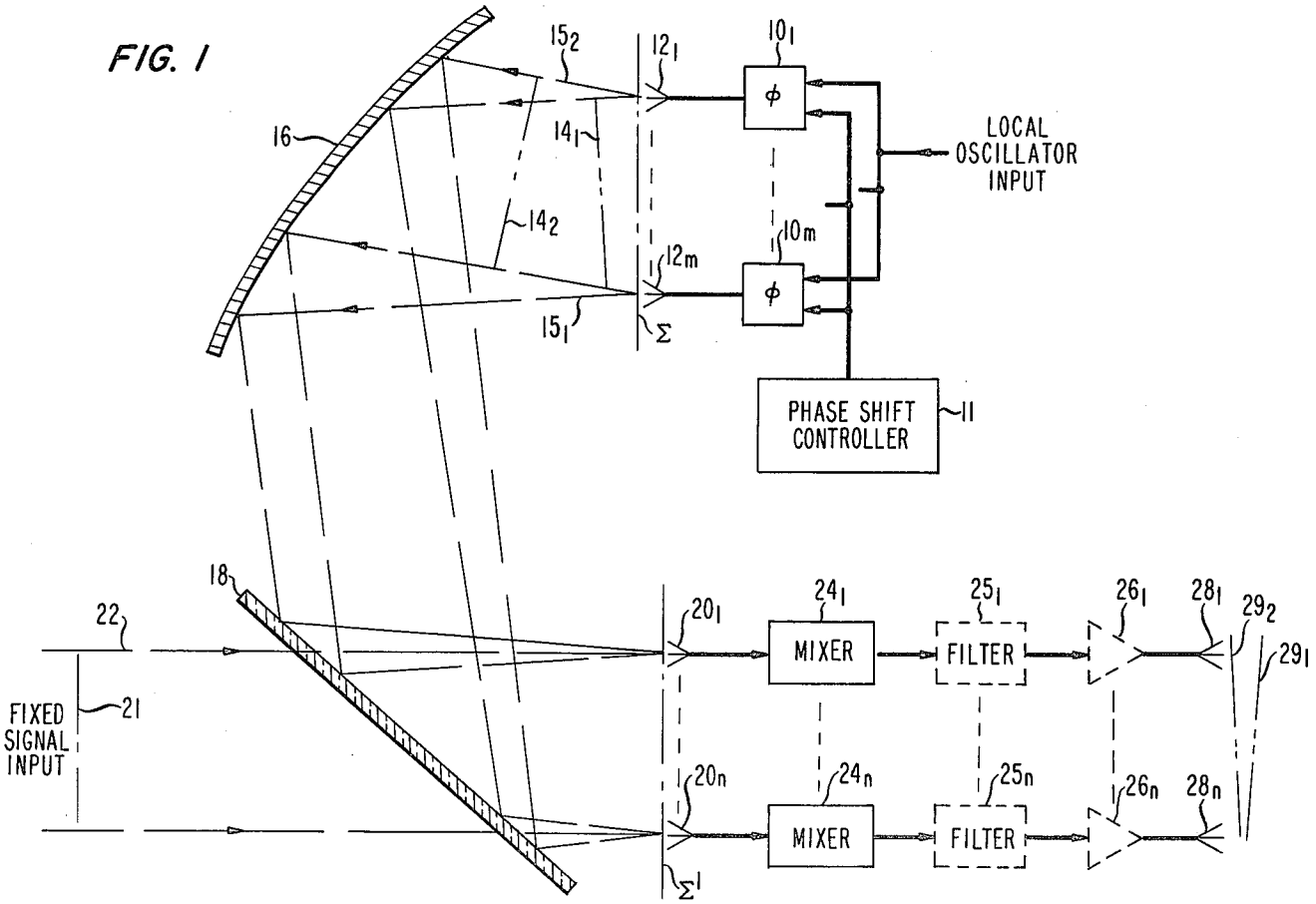
FIG. 1 is a phased array antenna system arrangement in accordance with the present invention for transmitting a spot beam to any portion of the field of view of the antenna system by selectively scanning a local oscillator signal spot beam.

Scanning of a phased array by means of a local oscillator signal beam for a transmitting phased array antenna system in accordance with the present invention is shown in FIG. 1. There, a local oscillator signal at a predetermined frequency, for use in modulation with a message signal for appropriate upconversion of the latter signal to the proper transmission frequency, is divided into m portions and each portion is applied to a separate one of m phase shifters $\mathbf{10}_1$–$\mathbf{10}_m$. Each of phase shifters $\mathbf{10}_1$–$\mathbf{10}_m$ function to introduce a separate predetermined instantaneous phase shift into the portion of the local oscillator signal propagating therethrough in response to a control signal from a phase shift controller 11 before such signal is transmitted by an associated separate feed element of a plurality of m feed elements $\mathbf{12}_1$–$\mathbf{12}_m$ forming a first array disposed on a plane Σ. The phase shifts introduced by phase shifters $\mathbf{10}_1$–$\mathbf{10}_m$ cause, for example, an instantaneous planar wavefront $\mathbf{14}_1$ or $\mathbf{14}_2$ in a beam $\mathbf{15}_1$ or $\mathbf{15}_2$, respectively, to be launched by feed elements $\mathbf{12}_1$–$\mathbf{12}_m$ with a predetermined tilt to plane Σ.

The resultant beam 15 is sequentially reflected by a focusing reflector 16 and a frequency diplexer 18, which frequency diplexer is turned in the arrangement of FIG. 1 to reflect the frequency band of the local oscillator signal, for reception by each of a plurality of n feed elements $\mathbf{20}_1$–$\mathbf{20}_n$ forming a second array disposed on the image plane Σ′ of the first array of feed elements $\mathbf{12}_1$–$\mathbf{12}_m$. Frequency diplexer 18 can comprise any suitable arrangement which is known in the art and functions to, for example, reflect a first frequency band signal and pass therethrough a second frequency band signal.

Concurrent with the arrival of a local oscillator signal wavefront 14 in a scanable beam 15 at feed elements $\mathbf{20}_1$–$\mathbf{20}_n$ of a second array, a planar wavefront 21 in a fixed directional spot beam 22 from a message signal source (not shown) at a frequency which permits such signal to pass through frequency diplexer 18 also arrives at feed elements $\mathbf{20}_1$–$\mathbf{20}_n$. It is to be understood that the message signal source can comprise any suitable source such as, for example, an array of feed elements or a single feedhorn with a focusing reflector such that at the aperture of the source a planar wavefront 21 is produced which propagates in a fixed direction towards feed elements $\mathbf{20}_1$–$\mathbf{20}_n$ of the second array. It is to be further understood that the frequency of the local oscillator signal and the message signal are such to produce the proper transmit frequency when combined, and for purposes of discussion hereinafter it will be assumed that the local oscillator frequency is close to the transmit frequency and that the message signal is a much lower frequency signal as, for example, an IF frequency.

The local oscillator signal and the message signal concurrently received in planar wavefronts 14 and 21, respectively, at each of feed elements $\mathbf{20}_1$–$\mathbf{20}_n$ are transmitted to a separate one of a plurality of n mixers $\mathbf{24}_1$–$\mathbf{24}_n$ where the frequencies and phases of the two signals are mixed. As stated hereinbefore, the frequencies of the local oscillator and message signals should have values which will produce an upconverted message signal within the desired transmit frequency band when mixed in mixers $\mathbf{24}_1$–$\mathbf{24}_n$. The output of each mixer 24 is transmitted to a separate associated one of a plurality of n feed elements $\mathbf{28}_1$–$\mathbf{28}_n$ forming a third array via a separate optional bandpass filter 25 and a separate optional amplifier 26. Each of bandpass filters $\mathbf{25}_1$–$\mathbf{25}_n$ is tuned to pass the components of the resultant mixed signals which lie within the desired transmit frequency band and reject all other unwanted components which could cause interference in the system. Bandpass filters $\mathbf{25}_1$–$\mathbf{25}_n$, of course, would not be required if mixers $\mathbf{24}_1$–$\mathbf{24}_n$ only produce signal components within the transmit frequency band or if other elements of the present antenna system such as, for example, waveguides suppress such unwanted components. Optional amplifiers $\mathbf{26}_1$–$\mathbf{26}_n$ can be used to provide the proper transmit power level if not already provided.

With reference to the mixing of the phase angles of the received local oscillator and message signals in each of mixers $\mathbf{24}_1$–$\mathbf{24}_n$, the phase of each received signal at each feed element is combined with the other signal in the associated mixer 24 and the combined phase value introduced in the upconverted message signal is also found at the associated feed element 28 of the third array to determine the tilt of the launched planar wavefront 29. For example, if the message signal beam 22 is oriented to arrive perpendicular to the image plane Σ′, on which feed elements $\mathbf{20}_1$–$\mathbf{20}_n$ are disposed, such that feed elements $\mathbf{20}_1$–$\mathbf{20}_n$ concurrently receive planar wavefront 21, then planar wavefront 21 will introduce a zero degree phase shift between all feed elements 20 and the phase shifts of the local oscillator planar wavefronts $14_1$ or $14_2$ introduced at each of feed elements $20_1$–$20_n$ will directly control the tilt of the RF planar wavefront $29_1$ or $29_2$, respectively, launched by feed elements $28_1$–$28_n$. Under conditions where the local oscillator frequency is close to the RF frequency, which condition will be used for conditions described herein, the tilt of the local oscillator planar wavefront 14 arriving at feed elements $20_1$–$20_n$ will approximately correspond to the tilt of the RF planar wavefront launched by feed elements $28_1$–$28_n$ toward a remote receiver.

If message signal beam 22 is not oriented perpendicular to image plane Σ', then planar wavefront 21 will arrive at an angle to the image plane and introduce a phase shift in the message signals received at feed elements $20_1$–$20_n$ which phase shift is then combined with the phase shift introduced by local oscillator planar wavefront 14 in mixers $24_1$–$24_n$. Under such condition the angle of tilt of planar wavefronts 14 and 29 will be different and the proper directionality of RF planar wavefront 29 is achieved by introducing appropriate phase shifts in phase shifters $10_1$–$10_m$ such that wavefront 14 arrives at the appropriate angle at feed elements $20_1$–$20_n$ to achieve such proper directionality of wavefront 29. It is to be further understood that where the local oscillator frequency is not close to the RF signal frequency, the angle that the local oscillator signal beam is scanned must be scaled by the ratio of the RF-to-local oscillator frequency in order to match the desired scan angle of the RF signal beam, and that such understanding also applies to discussions of FIGS. 2 and 3 hereinafter.

Figure 2:
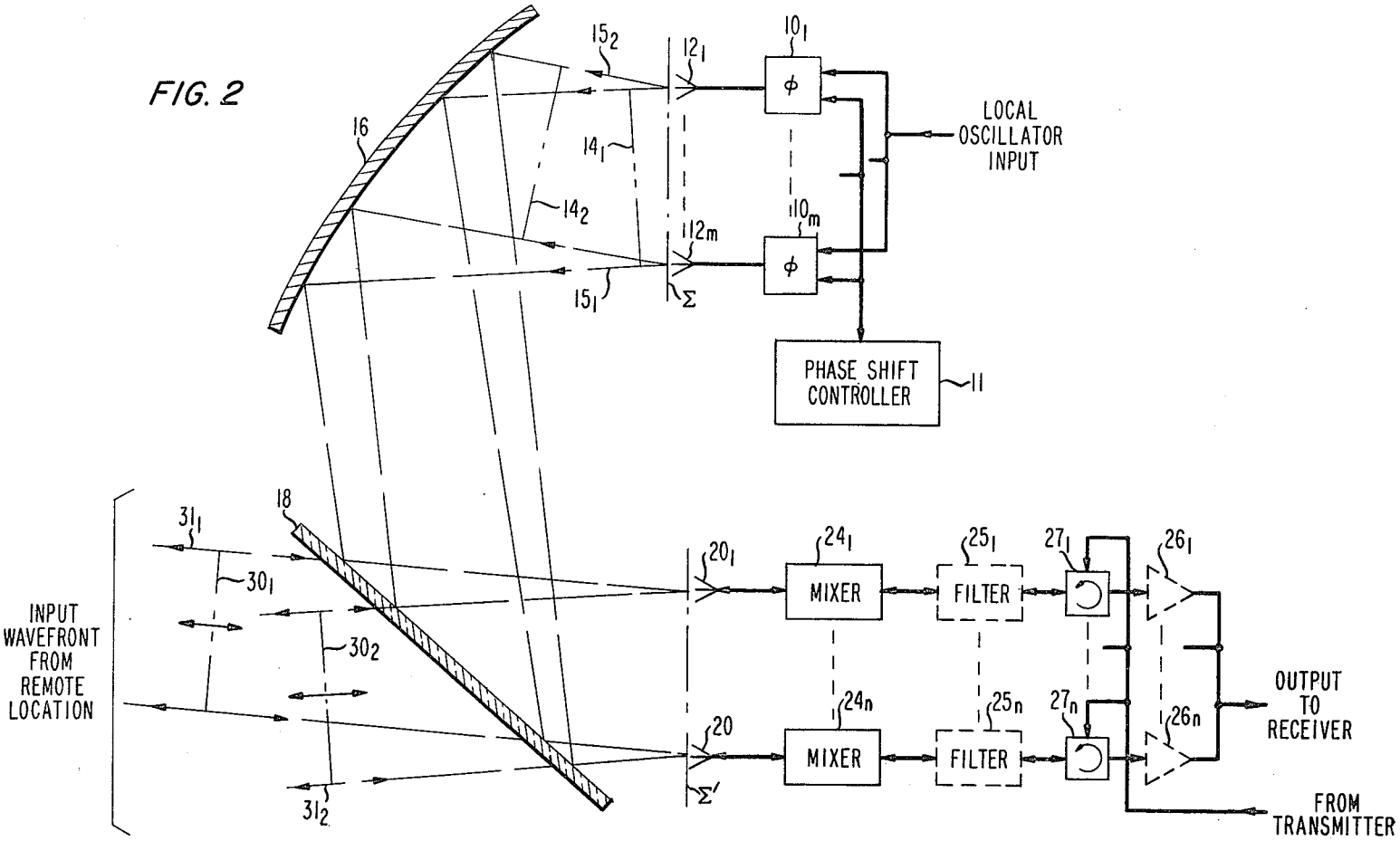
FIG. 2 is a phased array antenna system arrangement in accordance with the present invention for transmitting or receiving a message signal spot beam from any remote location in the field of view of the antenna system by selectively directing a local oscillator spot beam to match the direction of the desired message signal spot beam.

FIG. 2 illustrates a phased array antenna system arrangement in accordance with the present invention for receiving an RF message signal from a remote transmitter or for transmitting an RF message signal to a remote receiver. There, m components of a local oscillator signal are applied to separate phase shifters $10_1$–$10_m$ which introduce a separate predetermined phase shift into the local oscillator signal components, in response to control signals from a phase shift controller 11, to cause a predetermined directional planar wavefront 14 in a beam 15 to be launched by an array of feed elements $12_1$–$12_m$ disposed on a plane Σ. The resultant planar wavefront 14 is reflected by a focusing reflector 16 and a frequency diplexer 18 and then received at a second array of feed elements $20_1$–$20_n$ disposed on the conjugate or image plane Σ' of plane Σ. Therefore, the launching and propagation of the local oscillator signal beam 15 corresponds to that for the local oscillator signal beam of FIG. 1.

For reception of signals from a remote transmitter, one or mre RF message signal wavefronts 30 comprising signals in a predetermined RF frequency band arrive at the present antenna system in one or more associated beams 31 from predetermined directions within the field of view of the antenna system. The arriving wavefronts 30 are passed through frequency diplexer 18, which is tuned to reflect the local oscillator frequency and pass the predetermined RF frequency band, and arrive at feed elements $20_1$–$20_n$ of the second array concurrent with a local oscillator signal wavefront 14. The frequencies and phases of the message and local oscillator signals received at each of feed elements $20_1$–$20_n$ are mixed in a separate one of a plurality of n mixers $24_1$–$24_n$ to produce a difference frequency signal corresponding to a downconverted message signal. The resultant output signal from each of mixers $24_1$–$24_n$ is passed through an associated optional bandpass filter 25, circulator 27, and amplifier 26 before all output signals are combined and delivered to a local receiver. Optional bandpass filters $25_1$–$25_n$ are provided if mixers $24_1$–$24_n$ each also provide signal components which lie outside the desired difference frequency band and are not otherwise suppressed, and optional amplifiers $26_1$–$26_n$ are provided if the resultant output signal is not at a sufficient level for transmission to the local receiver.

For proper reception of a desired signal propagating in, for example, planar wavefront $30_1$ in beam $31_1$, phase shifts would have to be introduced by phase shifters $10_1$–$10_m$ into the local oscillator signal propagating therethrough to launch a planar wavefront as, for example, planar wavefront $15_1$ which will concurrently arrive with planar wavefront $30_1$ at feed elements $20_1$–$20_n$ with a direction such that when the phase shifts of the two desired signals are mixed in mixers $24_1$–$24_n$ a cophased signal will appear at the output of all mixers. Similarly, if it were desired to receive the signals in planar wavefront $30_2$, then phase shifters $10_1$–$10_m$ should introduce phase shifts in the local oscillator signal to cause the launching of, for example, planar wavefront $14_2$ which will provide a cophased signal at the output of all mixers $24_1$–$24_n$ when mixed with planar wavefront $30_2$. It follows that if the signal in, for example, planar wavefront $30_1$ were mixed with local oscillator planar wavefront $14_2$ no resultant cophased signal would appear at the output of mixers $24_1$–$24_n$.

It is shown in FIG. 2 that associated planar wavefronts of the message and local oscillator signal arrive at the same point on frequency diplexer 18 for concurrent propagation towards feed elements $20_1$–$20_n$. However, it is to be understood that such condition would only occur when the RF and local oscillator frequencies are close to each other. As stated hereinbefore, when the local oscillator frequency is not close to the RF frequency, the angle of the local oscillator beam must be scaled by the ratio of the RF-to-local oscillator frequency to achieve a cophased signal at the output of all mixers $24_1$–$24_n$. For purposes of transmitting a signal to a remote receiver in the arrangement of FIG. 2, the signal from the local transmitter is divided into n components and each component is gated by the associated circulator 27 through the associated optional filter 25 and mixer 24, where the transmission signal components are upconverted by the received local oscillator signal in wavefront 14. The resultant upconverted and properly phased signal components are then launched by feed elements $20_1$–$20_n$ in wavefront 30 to the remote receiver.

Figure 3:
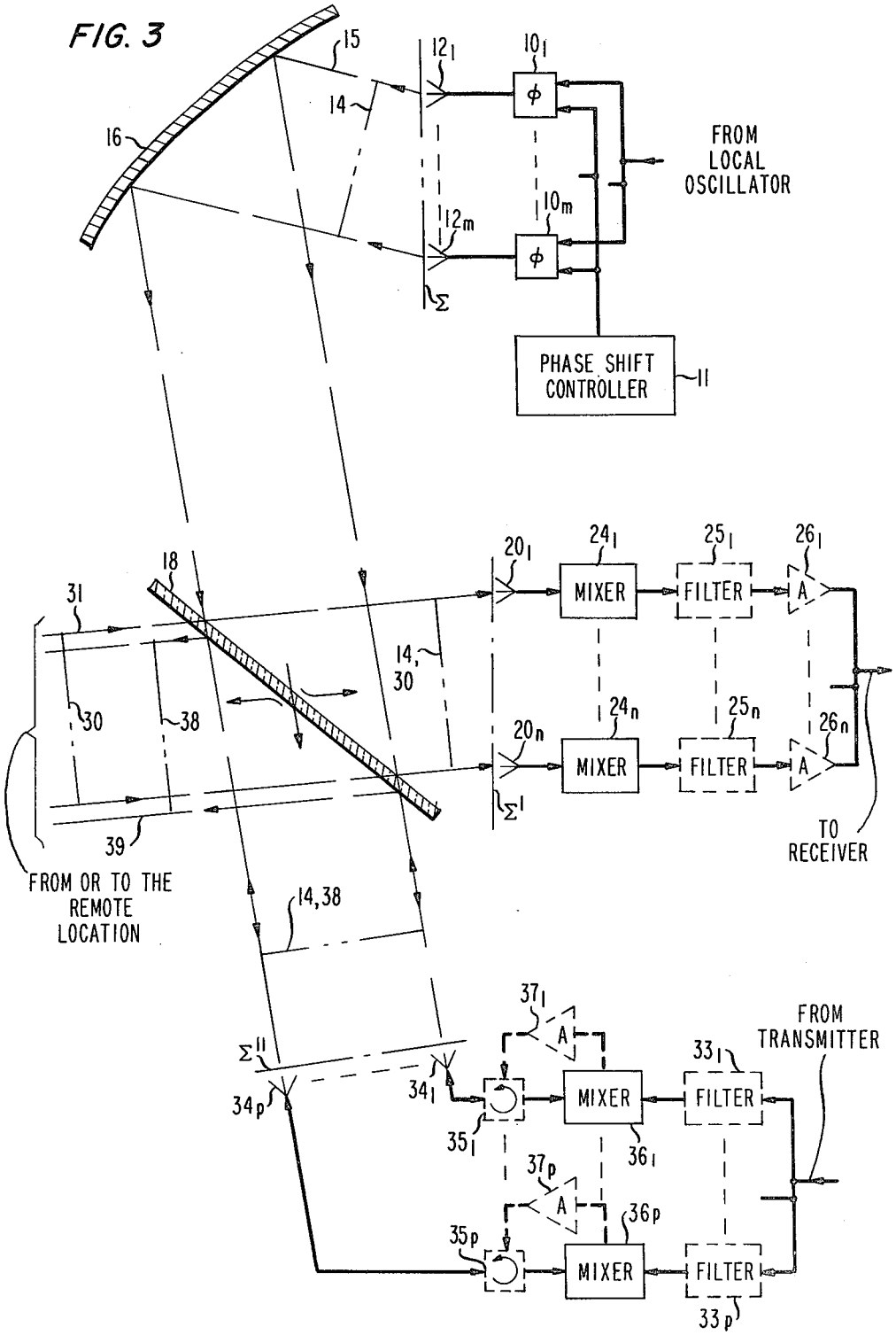
FIG. 3 is a phased array antenna system arrangement in accordance with the present invention for transmitting and receiving a message signal spot beam to and from a remote location in the field of view of the antenna system by appropriately directing a local oscillator signal spot beam.

FIG. 3 illustrates a typical combined transmitting and receiving phased array antenna system in accordance with the present invention which combines the concepts described hereinbefore for the separate arrangements of FIGS. 1 and 2. In the arrangement of FIG. 3, a local oscillator signal planar wavefront 14 in a predetermined directional beam 15 is formed by elements 10–12 in the manner described for corresponding elements 10–12 in FIGS. 1 and 2 with the resultant wavefront 14 being reflected by focusing reflector 16 toward frequency diplexer 18. Frequency diplexers are well known in the art and generally have response curves which resemble the curve of FIG. 4. For appropriate operation of the arrangement of FIG. 3, frequency diplexer 18 will be designed, and the pertinent signal frequencies will be chosen, such that the transmit RF frequency band lies below dashed line 40, the receive RF frequency band lies above dashed line 41 and the local oscillator frequency falls on a predetermined point 42 on the linear slope portion of the response curve.

In accordance with the conditions just outlined, the local oscillator wavefront 14 impinging on frequency diplexer 18 is partially reflected to be received by feed elements $20_1$–$20_n$ on image plane Σ′ of plane Σ, and the remaining portion of planar wavefront 14 passes through frequency diplexer 18 for reception by feed elements $34_1$–$34_p$ disposed on second image plane Σ″ of the plane Σ.

Figure 4:
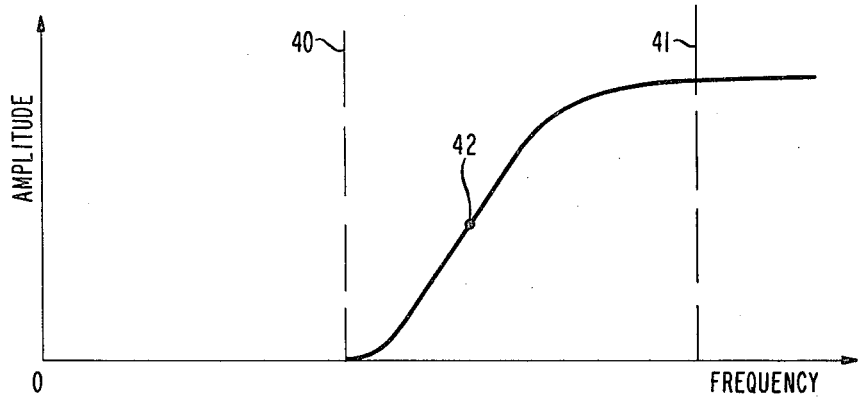
FIG. 4 is a response curve of a typical quasi-optical or frequency diplexer for use in the arrangement of FIG. 3.

In the receive section of the arrangement of FIG. 3, a planar wavefront 30 arriving in a beam 31 from a remote transmitter is within a frequency band above line 41 of FIG. 4 and, therefore, passes through frequency diplexer 18 and concurrently arrives at feed elements $20_1$–$20_n$ with the local oscillator signal planar wavefront 14. The local oscillator and message signals concurrently received at each of feed elements $20_1$–$20_n$ are processed in separate ones of mixers $24_1$–$24_n$, optional bandpass filters $25_1$–$25_n$ and optional amplifiers $26_1$–$26_n$ to derive cophased signals which are combined for transmission to a local receiver as outlined for the correspondingly numbered elements of FIG. 2.

In the transmit section of the arrangement of FIG. 3 which is a preferred embodiment over the arrangement of FIG. 1, the portion of the local oscillator signal passing through frequency diplexer 18 in planar wavefront 14 is intercepted by each of feed elements $34_1$–$34_p$ and transmitted by a separate optional circulator $35_1$–$35_p$ to an input of a separate mixer $36_1$–$36_p$. The individual local oscillator signals are mixed in mixers $36_1$–$36_p$ with a separate portion of, for example, a baseband or IF message signal to be transmitted, which is supplied by a local transmitter via filters $33_1$–$33_p$ to provide an upconverted message signal when the two signals are combined in mixers $36_1$–$36_p$. The output of each mixer 36 is sent via an optional amplifier 37 and the associated optional circulator 35, which is required only if amplifier 37 is used in the path between associated feed elements 34 and mixers 36, as mixer 36 would be bidirectional when amplifier 34 is not required, back to the associated feed element 34. Since the phase shifts received from planar wavefront 14 are the only ones introduced in the transmit section, such phase shifts will directly control the direction of a transmitted planar wavefront 38 which should substantially correspond to the specular direction of the tilt of phase wavefront 14 which specular direction is not shown in FIG. 3 for the sake of simplicity. Since the transmit frequency band is below dashed line 40 of FIG. 4, planar wavefront 38 will be reflected by frequency diplexer 18 and will propagate in beam 39 toward the remote receiver.

It is to be understood that the arrangement of FIG. 3 can be used for concurrently transmitting to and receiving from a particular remote location at any instant of time when the local oscillator beam is concurrently used by both the transmit and receive sections as, for example, when frequency diplexer 18 has point 42 tuned to pass and reflect approximately 50 percent of the local oscillator beam signal. The arrangement of FIG. 3 could also be modified to permit the reception of a beam 31 from a first remote location and the concurrent transmission of a beam 39 toward a second remote location. Such modification would merely require that a first directional local oscillator beam be launched using phase shifters $10_1$–$10_m$ at a first frequency which both lies below line 40 and is substantially near the zero amplitude level of the response curve of FIG. 4 so as to be essentially fully reflected by frequency diplexer 18 toward feed elements $20_1$–$20_n$ while a second directional local oscillator beam, using a separate set of phase shifters (not shown), is launched at a second frequency which both lies above line 41 and at the maximum amplitude level of the response curve of FIG. 4 to essentially permit the full passage of the second local oscillator frequency signal through frequency diplexer 18 toward feed elements $34_1$–$34_p$.

Figure 5:
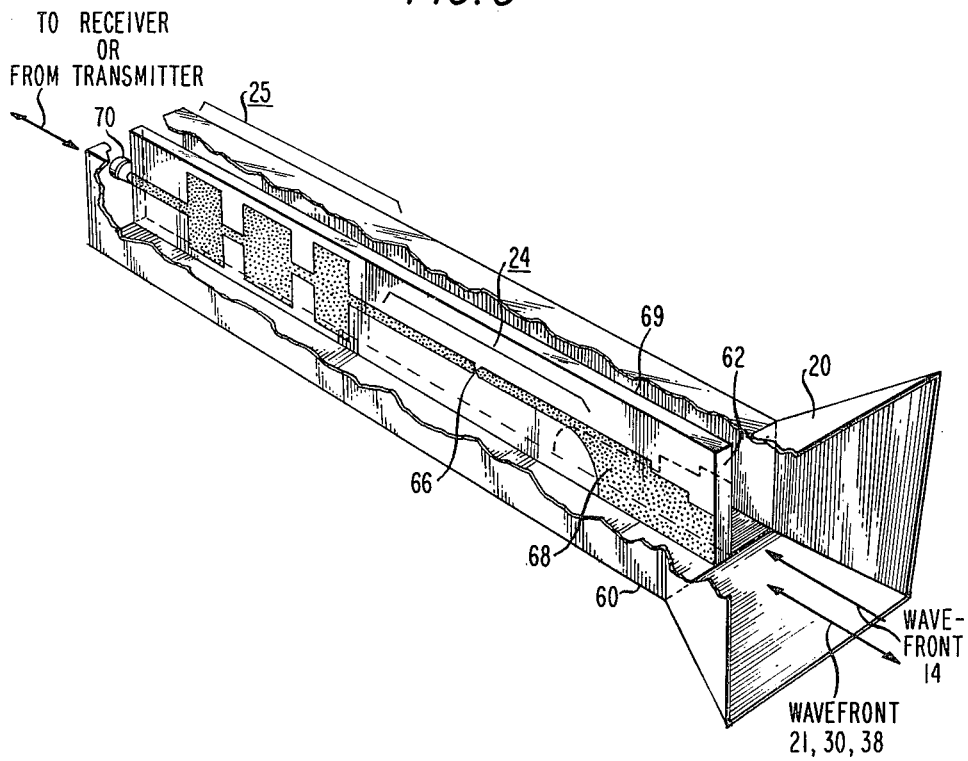
FIG. 5 is a view in perspective of a stripline mixer and filter arrangement for use in a feed element of the array of FIGS. 1–3.

FIG. 5 illustrates a stripline arrangement of a waveguide feed 20 including an exemplary mixer 24 shown in FIGS. 1–3 in combination with an exemplary filter 25 which are disposed within a waveguide section 60. In the arrangement of FIG. 5, a substrate 62 has deposited on major opposing surfaces thereof a first pattern of conductive material 68 shown by the stippled portion on the nearest surface to the viewer of FIG. 5, and a second pattern of conductive material 69 forming a conductive backing layer within the dashed border lines on the side of the substrate furthest from the viewer of FIG. 5. At the input end by horn 20, a transition section is shown wherein conductive patterns 68 and 69 are formed with a non-overlapping width starting at opposite edges at the end and are each stripwise increased in width until pattern 68 covers approximately one-half of the width of substrate 62 where it is gradually reduced in width from the edge to a central conductive lead, and pattern 69 covers the full width of substrate 62. Such transition section improves the transition from a signal entering the stripline arrangement from a waveguide section adjacent the input edge thereof.

A signal propagating through the stripline arrangement from the edge adjacent horn 20 first encounters a mixer section 24 formed by a solid state element such as, for example, a semiconductor diode 66 and a filter arrangement 25 formed from various widths of conductive material to form, for example, an RC filtering network as is well known in the art. The output of the stripline arrangement is shown as terminating in a connector 70 which may be used to connect the stripline arrangement to a coaxial line connected to an amplifier 26 or a receiver. It is to be understood that in FIG. 5 any suitable connection arrangement at the input or output can be used for matching connections to the component of the antenna to be connected to such stripline arrangement.

In operation, a local oscillator signal 14 and, for example, a fixed signal 21 or RF signal 30 or 31 are received at horn 20 of FIG. 5. The two signals then enter the stripline arrangement and are mixed in diode 66. The mixed local oscillator and fixed or RF signals are then filtered in filter section 25 to pass only a predetermined frequency band. In general the arrangement of FIG. 5 can be used to downconvert an RF signal 30 or 31 to IF or baseband using a proper local oscillator frequency within the feed element of an antenna before being delivered to a receiver or repeater via an optional amplifier 26.

It is to be understood that the above-described embodiments are simply illustrative of the principles of the invention. Various other modifications and changes may be made by those skilled in the art which will embody the principles of the invention and fall within the spirit and scope thereof. For example, in FIGS. 1–3 the transmit and/or receive sections could be disposed in relation to frequency diplexer 18 to, for example, reflect the received beam and pass through frequency diplexer 18 the local oscillator beam and vice versa for the transmit beam and associated local oscillator beam. It is also to be understood that the subscripts m, n and p in FIGS. 1–3 can denote that such subscripts can be equal or different in number. It is to be further understood that each of phase shifters $\mathbf{10_1}$–$\mathbf{10_m}$ can be replaced by a separate switching means which receives a separate enable signal from a switching controller 11 replacing phase shift controller 11 in FIGS. 1–3. In this manner a discrete beam can be launched by a feed element 12 located at the Fourier transform plane of Σ, rather than at Σ, which is directed to arrive at the feed array of elements $\mathbf{20_1}$–$\mathbf{20_n}$ or $\mathbf{34_1}$–$\mathbf{34_p}$ at the proper angle to achieve the proper cophasing of the message signal at feed elements $\mathbf{28_1}$–$\mathbf{28_n}$, $\mathbf{34_1}$–$\mathbf{34_p}$ or at the output of mixers $\mathbf{24_1}$–$\mathbf{24_n}$.

What is claimed is:

1. A phased array antenna system comprising:

a focusing means (16) comprising a predetermined aperture;

a plurality of m feed elements ($\mathbf{12_1}$–$\mathbf{12_m}$) disposed to form a first planar array directed at the focusing means; and a plurality of m phase shifters ($\mathbf{10_1}$–$\mathbf{10_m}$), each phase shifter being coupled to a separate one of the plurality of m feed elements and capable of introducing a particular separate phase shift to a signal in a first frequency band propagating therethrough in response to a remotely generated control signal to permit a particular first directional planar wavefront (14) to be launched by the feed elements of the first planar array characterized in that the first frequency band signal is a local oscillator signal and the antenna system further comprises:

diplexing means (18) disposed in the aperture of the focusing means and capable of directing both the first planar wavefront comprising the local oscillator signal and a second planar wavefront (21 or 30) comprising a message signal in a second frequency band propagating in a second direction at an image plane (Σ′) of the first planar array;

a plurality of n feed elements ($\mathbf{20_1}$–$\mathbf{20_n}$) forming a second planar array disposed on said image plane of the first planar array and directed at the diplexing means for intercepting the first and second planar wavefronts, where m and n can be a same or different integer; and a plurality of n mixing means ($\mathbf{24_1}$–$\mathbf{24_n}$), each mixing means comprising an input coupled to a separate feed element of the second planar array for mixing the local oscillator signal at a first frequency and the message signal at a second frequency to generate an output signal comprising the message signal at a third frequency for transmission from the antenna system.

2. A phased array antenna system comprising:

a focusing means (16) comprising a predetermined aperture for converting a spherical wavefront to a planar wavefront a plurality of m feed elements ($\mathbf{12_1}$–$\mathbf{12_m}$) disposed for forming a first planar array directed at the focusing means where each feed element launches a spherical wavefront toward the focusing means; and a plurality of m switching means ($\mathbf{10_1}$–$\mathbf{10_m}$), each switching means being coupled to a separate one of the plurality of m feed elements and capable of switching a signal in a first frequency band to the associated feed element in response to a remotely generated control signal to permit a particular first directional wavefront (14) to be launched by each of the associated feed elements of the first planar array characterized in that the first frequency band signal is a local oscillator signal and the antenna system further comprises:

diplexing means (18) disposed in the aperture of the focusing means and capable of directing both a first planar wavefront corresponding to a launched spherical wavefront from a feed element of the first planar array comprising the local oscillator signal and a second planar wavefront (21 or 30) comprising a message signal in a second frequency band propagating in a second direction at an image plane (Σ′) of a Fourier transform plate (Σ) of the first planar array;

a plurality of n feed elements ($\mathbf{20_1}$–$\mathbf{20_n}$) forming a second planar array disposed on said image plane of the Fourier transform plane of the first planar array and directed at the diplexing means for intercepting the first and second beams, where m and n can be a same or different integer; and a plurality of n mixing means ($\mathbf{24_1}$–$\mathbf{24_n}$), each mixing means comprising an input coupled to a separate feed element of the second planar array for mixing the local oscillator signal at a first frequency and the message signal at a second frequency to generate an output signal comprising the message signal at a third frequency for transmission from the antenna system.

3. A phased array antenna system according to claim 1 or 2 characterized in that the antenna system is a transmitting antenna system wherein each of the first and second planar wavefronts concurrently received by said plurality of n feed elements forming the second planar array introduce a first and a second phase shift, respectively, in the respective local oscillator and message signal received by each of the n feed elements of the second planar array which phase shifts are mixed in each associated mixing means, the antenna system further comprising:

a second plurality of n feed elements ($\mathbf{28_1}$–$\mathbf{28_n}$) forming a third planar array, each feed element of said third planar array being coupled to the output of a separate one of the plurality of n mixing means whereby the second plurality of n feed elements launch a third planar wavefront (29) comprising the message signal at an upconverted third frequency within a predetermined radio frequency band and in a predetermined direction which is dependent on mixed phase shifts generated by the plurality of n mixing means.

4. A phased array antenna system according to claim 3 characterized in that the second planar wavefront comprising the message signal in a second frequency band is capable of being only received from a predetermined fixed direction.

5. A phased array antenna system according to claim 1 or 2 characterized in that the antenna system is a receiving antenna system wherein the second frequency band associated with the message signal is within a predetermined radio frequency band and the outputs of the plurality of n mixing means are interconnected to provide a resultant output message signal at the third frequency band within a predetermined downconverted frequency band which is formed from the combination of a plurality of n cophased output signals from said plurality of n mixing means for transmission to a local receiver.

6. A phased array antenna system according to claim 5 characterized in that the diplexing means is a frequency diplexing means which is tuned to pass a first portion of the local oscillator signal impinging thereon in the first directional planar wavefront and reflect a second portion of the local oscillator signal impinging thereon in said first directional planar wavefront with one of said portions being received by the plurality of n feed elements forming the second planar array concurrent with the message signal at the second frequency; and the antenna system further comprises:

a transmitting section comprising:

a plurality of p feed elements ($\mathbf{34}_1$–$\mathbf{34}_p$) forming a third planar array disposed to receive a remaining portion of the local oscillator signal impinging on the frequency diplexing means and not received by the plurality of n feed elements forming the second planar array;

a plurality of p mixing means ($\mathbf{36}_1$–$\mathbf{36}_p$), each mixing means being coupled to a separate feed element of said plurality of p feed elements and capable of mixing the local oscillator signal received at the associated feed element with a transmit message signal applied to all of said plurality of p mixing means for generating an output signal representative of such mixing which is directed back to said plurality of p feed elements of the third planar array at a predetermined transmit radio frequency band to cause a planar wavefront (38) launched by said plurality of p feed elements, when impinging the frequency diplexing means, to propagate in the direction opposite that of the second planar wavefronts.

7. An antenna system feed element comprising;

a hollow waveguide section; and a stripline arrangement mounted within the hollow waveguide section, the stripline arrangement comprising a substrate including a first and a second end thereof, and a first and a second patterned layer of an electrically conductive material disposed on opposing first and second major exposed surfaces, respectively, of the substrate, the first and second patterned layers at a first end of the substrate being widened for contacting a first and a second opposing wall, respectively, of the waveguide section for forming a transition section for improving the transition of a signal entering the first end of the stripline arrangement, a filter section disposed adjacent the second end of the stripline arrangement capable of passing a predetermined frequency band, and an unbalanced mixer section disposed between the transition and filter sections and capable of mixing a first signal received at the first end of the stripline arrangement with a second signal in a first frequency band received at either one of the first and second ends of the stripline arrangement for generating a third signal in a second frequency band which is transmitted from the end of the stripline arrangement opposite the receiving end of the second signal.

8. An antenna system feed element according to claim 7 wherein the unbalanced mixer section comprises a solid state element connected to two narrow strips of electrically conductive material in the first patterned layer.

9. An antenna feed element according to claim 7 or 8 wherein the filter section comprises an alternating pattern of wide and narrow interconnected sections of the electrically conductive material forming the first patterned layer.

* * * * *